US011684128B2

(12) United States Patent
Tone

(10) Patent No.: US 11,684,128 B2
(45) Date of Patent: Jun. 27, 2023

(54) SOLAR POWERED JEWELRY, ADORNMENT AND FASHION ACCESSORY

(71) Applicant: Sharon Tone, Santa Cruz, CA (US)

(72) Inventor: Sharon Tone, Santa Cruz, CA (US)

( * ) Notice: Subject to any disclaimer, the term of this patent is extended or adjusted under 35 U.S.C. 154(b) by 0 days.

(21) Appl. No.: 17/851,082

(22) Filed: Jun. 28, 2022

(65) Prior Publication Data

US 2023/0000223 A1 Jan. 5, 2023

Related U.S. Application Data

(60) Provisional application No. 63/217,873, filed on Jul. 2, 2021.

(51) Int. Cl.

| | |
|---|---|
| ***A44C 15/00*** | (2006.01) |
| ***F21S 9/03*** | (2006.01) |
| ***A44C 13/00*** | (2006.01) |

(52) U.S. Cl.
CPC ..... *A44C 15/0015* (2013.01); *A44C 13/00* (2013.01); *F21S 9/03* (2013.01)

(58) Field of Classification Search
CPC ..... F21S 9/03; A44C 13/00; A44C 15/0015
See application file for complete search history.

(56) References Cited

U.S. PATENT DOCUMENTS 10,674,588 B2 * 6/2020 Kelly ..... A44C 15/005
11,134,759 B2 * 10/2021 Keeler ..... A44C 15/0015

FOREIGN PATENT DOCUMENTS

KR 20210133683 A * 11/2021

* cited by examiner

*Primary Examiner* — Anabel Ton
(74) *Attorney, Agent, or Firm* — Brennan, Manna & Diamond, LLC

(57) ABSTRACT

The present invention relates to an illumination article designed to illuminate using solar light or any other captured light. The article can be designed in form of an adornment, jewelry, fashion accessory or other item. More specifically, the article has a solar rope string with a plurality of photo-cells for capturing light and converting it into electric energy, a plurality of LEDs supported by the string for illuminating at least a portion of the article, a plurality of beads or crystals and a sun catcher for creating a sparkling effect using natural light impinging on article and light illuminated by LEDs. The LEDs can illuminate in a uniform manner, intermittent, running or in a blinking manner.

17 Claims, 7 Drawing Sheets

SOLAR POWERED JEWELRY, ADORNMENT AND FASHION ACCESSORY

CROSS-REFERENCE TO RELATED APPLICATION

The present application claims priority to, and the benefit of, U.S. Provisional Application No. 63/217,873, which was filed on Jul. 2, 2021, and is incorporated herein by reference in its entirety.

FIELD OF THE INVENTION

The present invention relates generally to the jewelry and other personal and fashion accessories. More specifically, the present invention relates to solar powered fashion accessories such as glow jewelry designed to replace standard plastic, throwaway glow items, party favors and other chemically powered accessories. The accessory item features several different colors and styles available in green, blue, and other colors and hues, and is capable of being installed within necklaces, bracelets, wristbands, charms, pendants, broaches, rings, earrings, helix piercing rings, loops and pins, and other similar items. The fashion accessory, such as jewelry, includes photocells for capturing solar light and light emitting diodes ("LED") for illumination. Accordingly, the present disclosure makes specific reference thereto. Nonetheless, it is to be appreciated that aspects of the present invention are also equally applicable to other like applications, devices, and methods of manufacture.

BACKGROUND

By way of background, people, especially at parties, beaches, social events, reveal parties, and on holidays or when participating in holiday events, such as Halloween, day of the dead celebrations, enjoy using and wearing glow sticks, glow necklaces, wristbands, and other items that can be illuminated to create a festive mode or to further accentuate the theme. Generally, such glowing accessories and jewelry are chemiluminescent containing chemical substances that are mixed to produce light and generate a colored glow. However, such accessories or jewelry are not reusable and are typically discarded after use creating additional and unnecessary waste. People are required to throw them away after chemiluminescence is exhausted. This is not only expensive but also requires people to carry multiple glowing items of the same type and regularly repurchase such items to participate in the next event or in prolonged duration events.

Many glowing accessories are made from fluorescence and phosphorescence technology for illumination. However, such glowing accessories only glow for a short period of time and are unusable after the glow period has elapsed.

Some people like metallic chains and pendants and currently glowing techniques are not efficient with such aesthetically desirable items and accessories. People desire improved glowing accessories that can come in the form of necklaces, bracelets, wristbands, charms, pendants, broaches, rings, earrings, helix piercing rings, loops and pins, and other similar or combination of items.

Therefore, there exists a long-felt need in the art for a glowing fashion accessory such as, jewelry or other adornment, that is designed to be reusable. There is also a long-felt need in the art for a glowing fashion accessory, adornment or jewelry that does not require the use of any chemical substances for illumination. Additionally, there is a long-felt need in the art for an improved glowing wearable accessory item that is safe to wear by a user. Moreover, there is a long-felt need in the art for glowing adornment, accessory or jewelry that comes in various forms including necklaces, bracelets, wristbands, charms, pendants, broaches, rings, earrings, helix piercing rings, loops and pins, other combinations, and other similar items. Further, there is a long-felt need in the art for an improved adornment, accessory or jewelry that can remain illuminated for longer periods of time and has a longer life. Finally, there is a long-felt need in the art for an improved adornment, accessory or jewelry item that is cost-effective, multipurpose and use a free source of energy such as solar energy for providing power for illumination of the jewelry.

The subject matter disclosed and claimed herein, in one embodiment thereof, comprises a solar powered reusable adornment, accessory or jewelry. The adornment, accessory or jewelry is designed as a rechargeable and usable fashion accessory to replace standard plastic, throwaway glow items. The jewelry or accessory comprises a thin solar rope string, with the string having a plurality of photocells integrated therein. The photocells are configured to capture solar energy and convert the solar energy into electric energy. LED strips are provided and supported by the solar rope string and run along the length of the string. A button battery for storing the converted electric energy, and the LED strips are configured to illuminate using the stored electric power. The electric power is automatically provided to the LED strips from the button battery when clasps of the jewelry are snapped together creating an electrical connection or manually by using a button positioned on the clasps and a pendant having an illuminating element for capturing solar light and illuminating the element.

In this manner, the reusable glowing adornment, accessory or jewelry of the present invention accomplishes all of the forgoing objectives and provides users with solar powered glow accessories designed to replace standard plastic, throwaway glow items. The adornment, accessory or jewelry is recharged via solar energy or any other suitable light source for illumination at night or in dark areas. The adornment, accessory or jewelry provides a plurality of illumination effects and can be available in a variety of colors and styles. The jewelry can be in one or more of the form of necklaces, bracelets, wristbands, charms, pendants, broaches, rings, earrings, helix piercing rings, loops and pins, combinations and other similar items.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a solar powered reusable adornment, accessory or jewelry. The adornment, accessory or jewelry has a thin solar rope string, and the string includes a plurality of photocells integrated along the length of the string. The photocells are configured to capture solar energy and convert the energy into electric energy. LED strips may run along the length of said string or be disposed in a pattern or other suitable configuration. A button battery is provided for storing the converted electric energy. The LED strips are configured to illuminate using the stored electric power. The electric power is automatically provided to the LED strips from the button battery when the clasps, closures or other connectors of the jewelry, adornment or accessory are snapped or connected together. A pendant or other collector is provided and has an illuminating and collection element for capturing solar light and illuminating.

In yet another embodiment, the thin solar rope string is accommodated in a transparent or translucent cord, clasps or closures are positioned at opposite ends of the cord or at other locations to accommodate the design attribute of the adornment.

In yet another embodiment, the thin solar rope string has conductive circuit along the length for transmission of electric power to each of the illumination elements.

In yet another embodiment, an article of illuminated jewelry is disclosed. The article of jewelry, adornment or fashion accessory comprises a light source for illuminating at least a portion of the item. A battery is provided to power the light source and the battery is positioned in a clasp or other closure of the item or accessory. A plurality of photocells is positioned in at least a portion of the jewelry, item or accessory for converting solar energy into electrical energy and the electrical energy is used by the light source for illumination. A plurality of crystals, beads, or other design elements and a sun catcher are provided for creating a sparkling effect using the natural light impinging on the jewelry, adornment or accessory and artificial light provided by the light source.

In yet another embodiment, the light source is accommodated in nylon, plastic, or metal cord of the jewelry.

In yet another embodiment, the light source is a strip of light emitting diodes (LEDs) and may be operated in a continuous mode, intermittent mode, flashing or other desired lighting effects.

In yet another embodiment, the light source is disposed on a rope string having a diameter ranging from about 1/32 of an inch to about 2 inches, with about 1/4 of an inch to about 1 inch being preferred.

In yet another embodiment, the LEDs provide a uniform illumination or alternatively provides a blinking effect and may be operated on different circuits so that they can be operated simultaneously, substantially simultaneously or sequentially.

In yet another embodiment, an illuminated jewelry, adornment or other fashion accessory article is disclosed. The personal illuminated article includes a plurality of LEDs, each of the LEDs is configured to illuminate in a specific color or different colors and an elongated flexible string or cord having a plurality of photocells for capturing solar energy and converting the collected energy into electric energy. The LEDs are attached to an elongated flexible string, cord or rope, and a battery is provided for storing electric energy. The battery is coupled to one or more conductive circuits disposed on or in the elongated flexible string, and a pendant or other item is provided and includes an illuminating element having photocell.

In yet another embodiment, a solar rechargeable glow accessory is disclosed. The accessory is made with transparent beads, rings, and other design elements that glow green, blue, or any other desired color and has a solar rope string or cord that can be charged using solar light or any suitable light for glowing at night.

In yet another embodiment, the solar rope string for the wristband embodiment is about 9 mm×2.0 mm×2.2 mm.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
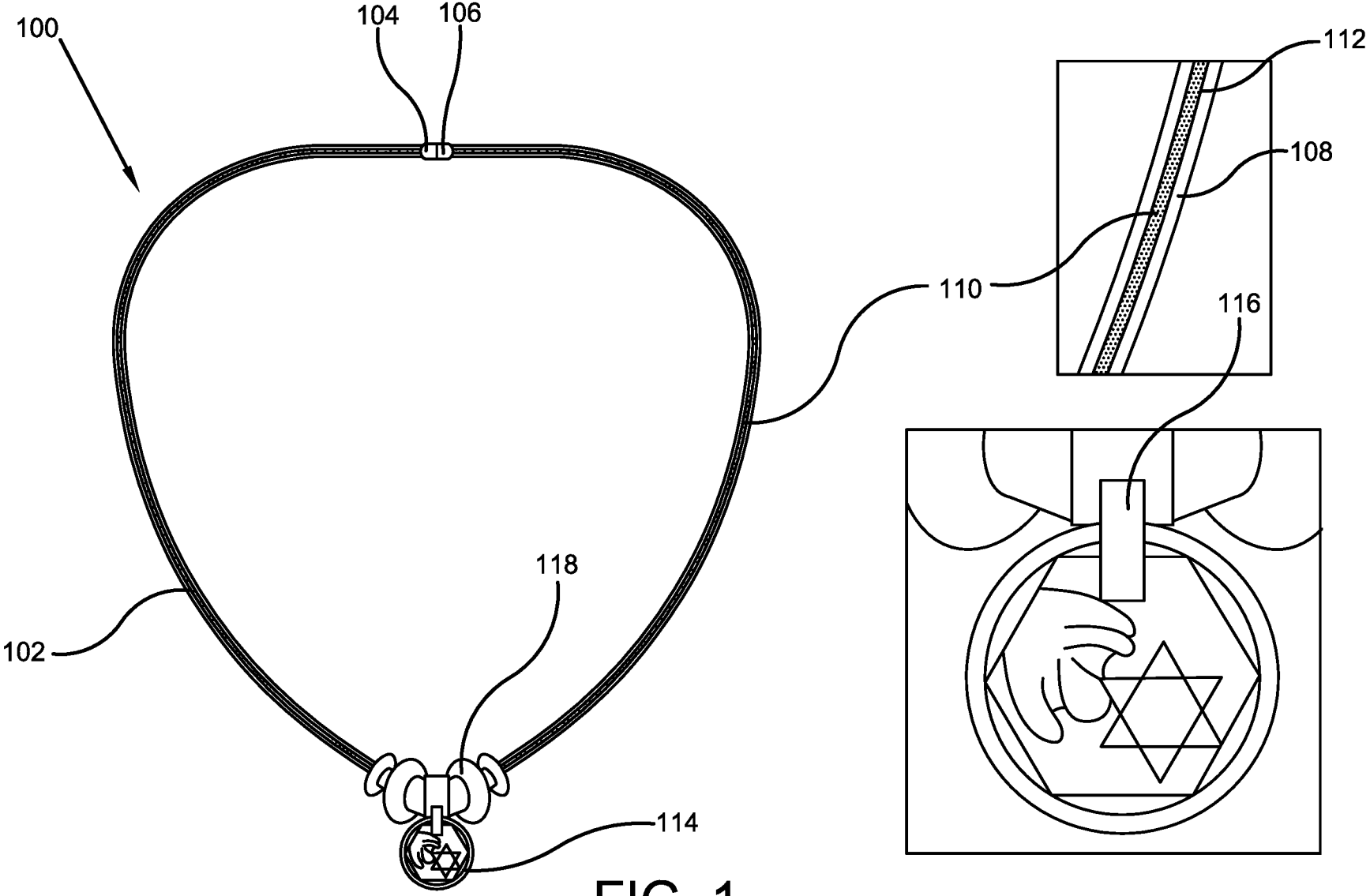
FIG. 1 illustrates a perspective view of one potential embodiment of the solar powered glowing article of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown.

Thus, in other embodiments, any of the features described herein from different embodiments may be combined.

As noted above, there is a long-felt need in the art for a glowing jewelry, adornment, fashion accessory, or the like, that is designed to be reusable without taking away from the functionality of disposable illumination items. There is also a long-felt need in the art for a glowing item that does not use any chemical substances for illumination. Additionally, there is a long-felt need in the art for an improved glowing wearable accessory item that is safe to wear by a user. Moreover, there is a long-felt need in the art for glowing accessory that comes in various forms including necklaces, bracelets, wristbands, charms, pendants, broaches, rings, earrings, helix piercing rings, loops and pins, combinations, and other similar items. Further, there is a long-felt need in the art for an improved jewelry that can illuminate for longer periods and has a longer life than disposable items. Finally, there is a long-felt need in the art for an improved illumination accessory item that is cost-effective, multipurpose and uses a free source of energy, such as solar energy, for providing power for illumination of the accessory.

The present invention, in one exemplary embodiment, is a novel illumination article. The illumination article comprises a light source for illuminating at least a portion of the article, and a battery for providing power to the light source. The battery is positioned in a clasp or other closure of the jewelry, and a plurality of photocells that are positioned in at least a portion of the jewelry for converting solar energy into electrical energy. The electrical energy is used by the light source for illumination. The article further comprises a plurality of crystals, design elements or beads and a sun catcher for creating a sparkling effect using the natural light impinging on the jewelry, as well as the artificial light provided by the light source.

Referring initially to the drawings, FIG. 1 illustrates a perspective view of one potential embodiment of the solar powered glowing illumination accessory 100 of the present invention in accordance with the disclosed specification. The glowing accessory 100 of the present embodiment is in the form of a necklace that has a transparent or translucent nylon cord 102 having magnetic clasps or closure ends 104, 106. The magnetic clasp or closure ends 104, 106 are configured to make a closed loop of the cord 102. It should be noted that the cord 102 may have hook, loop or any other fastening or closing mechanism for making a closed loop. The closing of the rope or cord may also complete the circuit to enable the illumination feature to commence the illumination cycle.

The nylon cord 102 is hollow and has a cavity 108, having a diameter ranging from 1/32" to about 2", running through length of the cord 102 for accommodating a solar rope string 110. The solar rope string 110 runs from the first clasp end 104 to the opposite clasp end 106. The solar rope string 110 is configured to have continuous photocells (shown in FIG. 2) along the length for capturing solar light. The solar rope string 110 also has LEDs 112 disposed thereon that illuminate using the captured solar light. The solar rope string 110 can be easily accommodated in the nylon cord 102 and enables the necklace 100 to glow at night, in low illumination, or dark areas. The photocells may be interspersed with the LEDs in equal instances, or the photocells may be provided in groups or sets at a different portion of the rope and the LEDs provided at other areas or in the same areas as the photocells.

The illumination article such as a necklace 100 has a pendant 114 that is fixedly attached to, or hangs from, the nylon cord 102. The pendant 114 can have any shape and size and has a solar powered illuminating element 116. The solar powered illuminating element 116 provides illumination in the pendant and uses solar energy for power.

The illumination article, such as a necklace 100, has transparent beads, other design/decorative elements and crystals 118 that reflect or enhance the light illuminated by solar rope string 110 for creating a glowing effect. The beads, decorative elements or crystals 118 can also be in a specific color for providing glow in a specific or multicolor.

Figure 2:
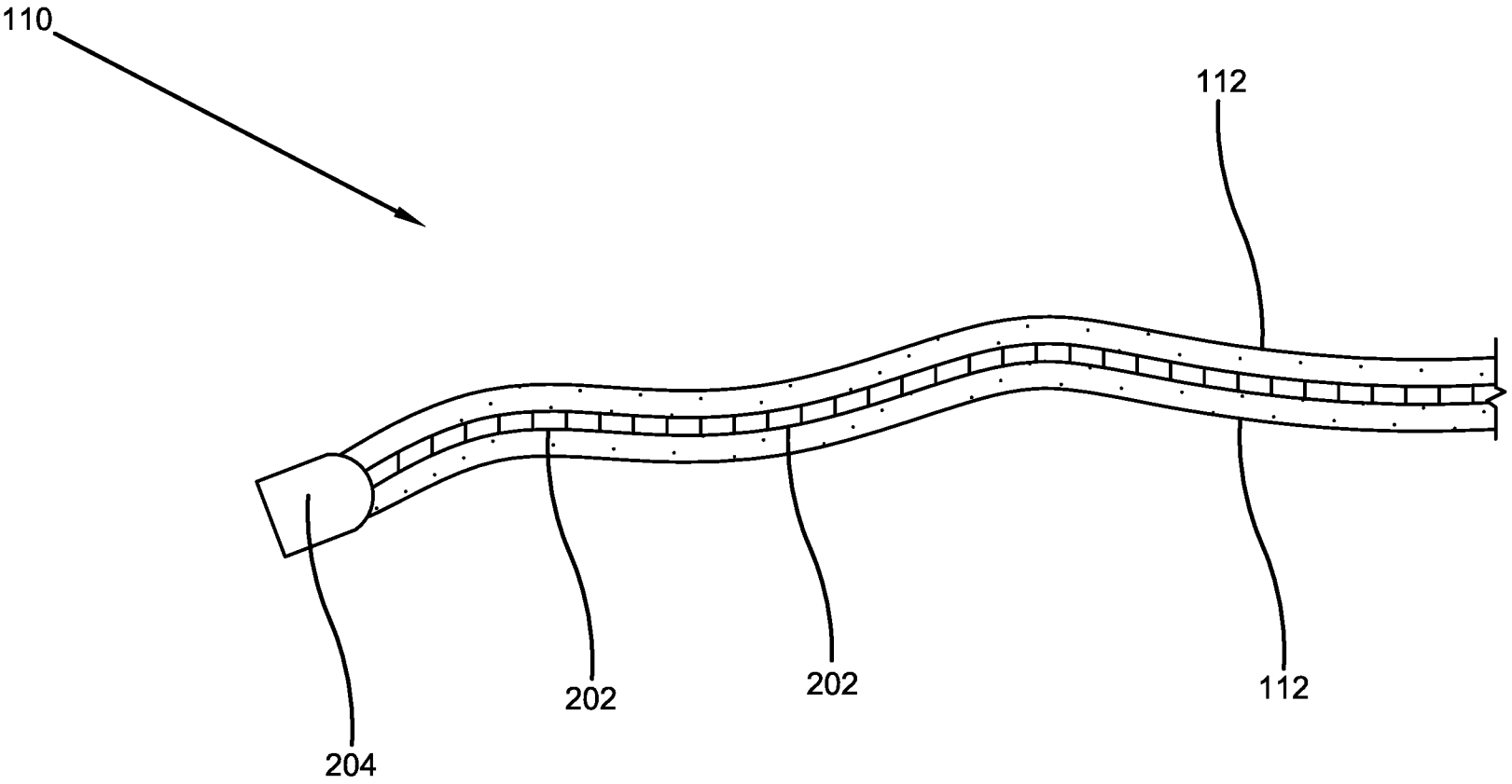
FIG. 2 illustrates a close-up perspective view of one potential embodiment of the solar rope string used in the glowing accessory of FIG. 1 in accordance with the disclosed architecture.

FIG. 2 illustrates a close-up view of the solar rope string 110 used in glowing necklace 100 of FIG. 1 in accordance with the disclosed specification. As illustrated, the solar rope string 110 has a plurality of photocells 202 for capturing solar energy. The photocells 202 are disposed in the string 110 and are designed to capture enough solar energy in an hour to allow illumination of the LEDs 112 for more than six hours.

More specifically, the LEDs 112 are adhered or integrated along the surface of the string 110 and provide illumination, in a continuous, intermittent, flashing, running or circling effect or any other desired illumination effects. The string 110 has an associated button battery 204 that is configured to store electric power produced by the photocells 202. The button battery 204 is preferably positioned inside one of clasps or closures of the necklace or fashion accessory 100 and provides power to the LEDs 112. The nylon rope or cord 102 is configured to protect the solar rope string 110 from weather elements and further the solar rope string 110 is designed as a weatherproof structure.

It should be noted that the string 110 functions as an electrical conductor that provides power to LEDs 112 and stores power in the button battery 204. In the preferred embodiment of the necklace 100, electrical power is automatically drawn from the battery 204 when the clasps 104 106 are snapped or connected together (using a sensor as described in FIG. 3) allowing the necklace 100 (solar string 110) to glow. Alternatively, in other embodiments, one of the clasps or connectors 104, 106 may have a button to manually activate glowing of the necklace.

Figure 3:
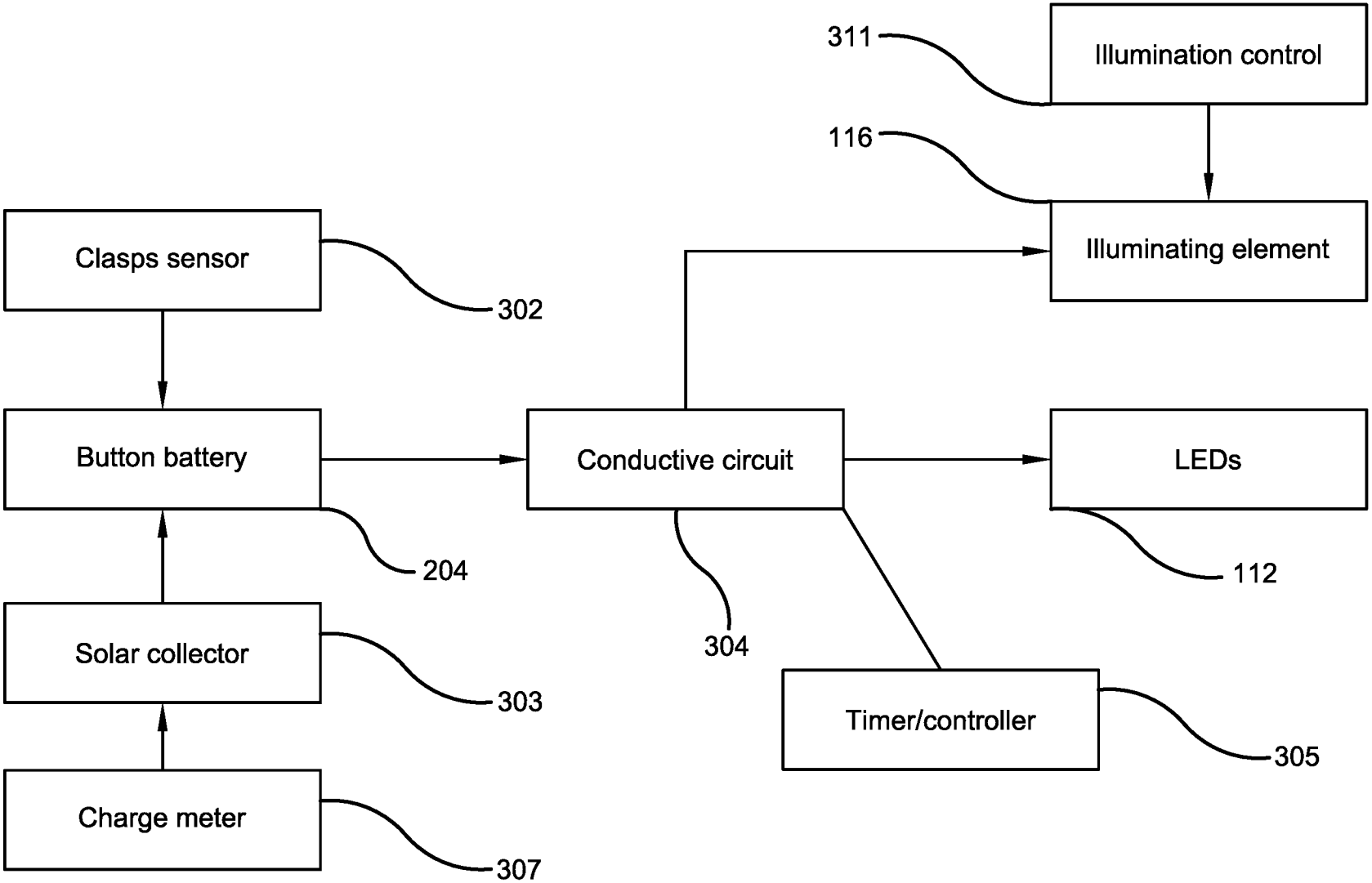
FIG. 3 illustrates a functional block diagram showing the connections for providing electric power for illumination of the solar powered accessory of FIG. 1 in accordance with the disclosed architecture.

FIG. 3 illustrates a functional block diagram showing connection for providing electric power for illumination of necklace 100 of FIG. 1 in accordance with the disclosed specification. As illustrated, a clasp or closure sensor 302 positioned on the clasps of the necklace automatically senses closure, or snapping of the clasps, and activates the button battery 204 to discharge current through conductive circuit 304 of the solar rope string 110. The conductive circuit 304 is made of an electrically conductive material and is configured to carry electric current.

The electric power stored in the button battery 204, after conversion of captured solar energy, is accordingly provided to LEDs 112 and illuminating element(s) 116 of the illumination article. The LEDs can be single colored or multicolored and further can produce a uniform illumination, sequential operation, running effect, or alternatively can be blinking LEDs. The lighting effects are controlled by a timer and/or controller 305, which may also include a battery or energy saver mode where the LEDs are turned off when there is no movement. The battery 204 is connected to a solar collector or photocell 303 which may have a power or charge meter 307 for determining the charge level of the battery. The illumination element 116 may be connected to an illumination control 311 to change the intensity of the LED and allow the user to select high, medium and low intensities.

Figure 4:
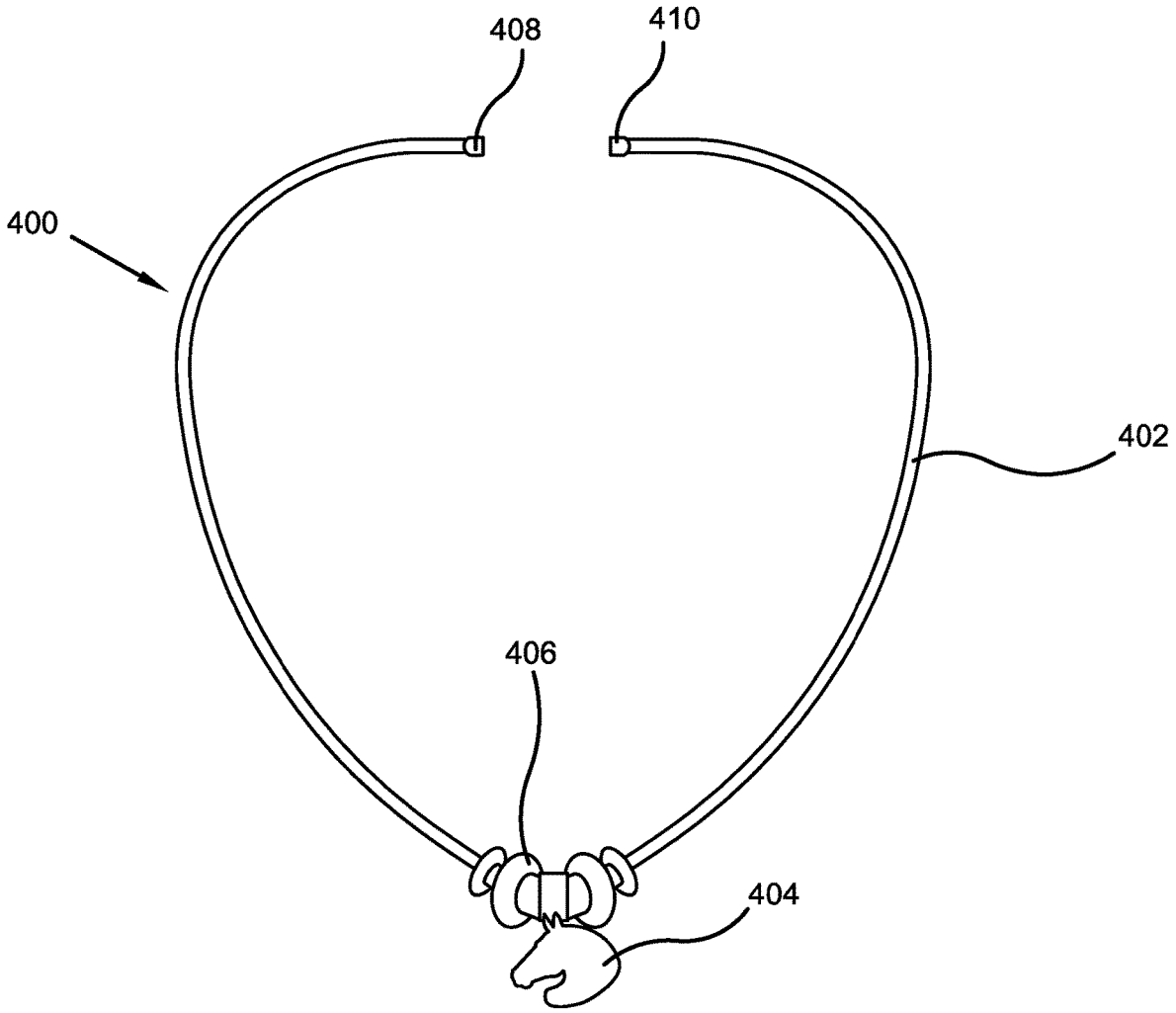
FIG. 4 illustrates a perspective view of another potential embodiment of the solar powered glowing accessory of the present invention in accordance with the disclosed architecture.

FIG. 4 illustrates a perspective view of another embodiment of the solar powered glowing fashion accessory, adornment, jewelry, illumination article or other item of the present invention in accordance with the disclosed specification. In the present embodiment, the illumination article 400 has a solar string equipped cord 402 that can also be in the form of a chain, rope or tube and has a horse shaped pendant 404. Both the cord 402 and the pendant 404 are configured to glow in dark and low light areas using solar energy captured by the solar string. The clasps or closures 408, 410 are used for securing the necklace 400 and for making a closed loop. Further, the clasps or closures 408, 410 also include a miniature battery for providing power to the illuminating LEDs and illuminating elements in a manner similar to the manner described in other embodiments of the present invention. The article 400 has a number of design elements 406 to further accessorize the article 400.

Figure 5:
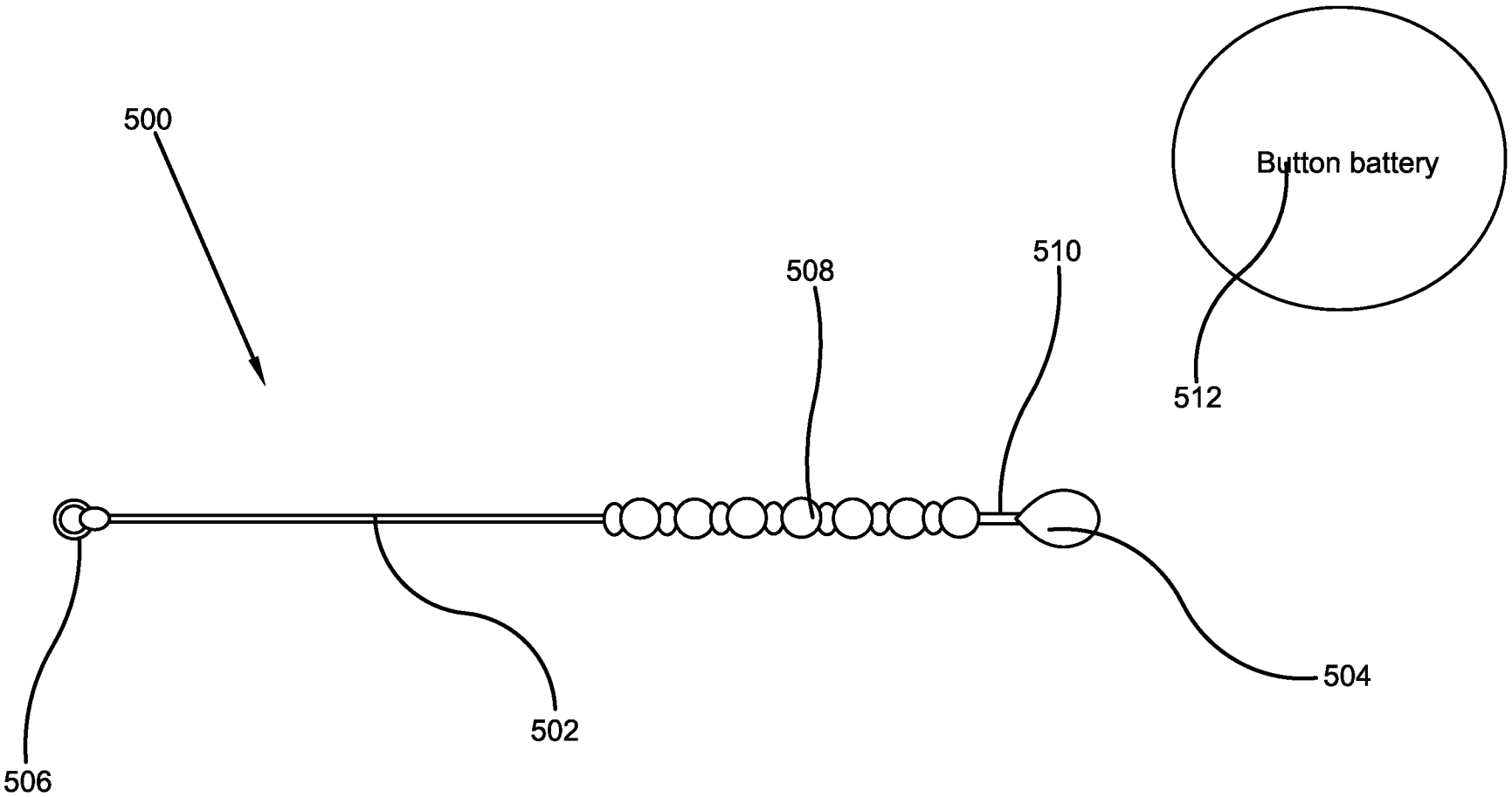
FIG. 5 illustrates a perspective view showing yet another potential embodiment of the solar powered glowing article of the present invention in accordance with the disclosed architecture.

FIG. 5 illustrates a perspective view showing yet another embodiment of the glowing illumination article of the present invention in accordance with the disclosed specification. In the present embodiment, the illumination article is in the form of a bracelet 500 that has a solar rope string equipped cord 502 having a sun catcher 504 at one end and a hook 506 at the opposite end. The cord 502 has a plurality of multicolored beads, crystals, or other design/decorative elements 508 for providing aesthetic appeal to the article. A power module 510 is disposed adjacent to the sun catcher 504 that includes a button battery 512 for storing electric power transformed by the solar rope string of the cord 502.

The sun catcher 504, along with the crystals 508, help facilitate or create a sparkling effect. Further, the crystals 508 can be of multiple colors as per desire of the wearer. The cord 502 can also be made from any malleable and ductile metal such as gold or silver.

Figure 6:
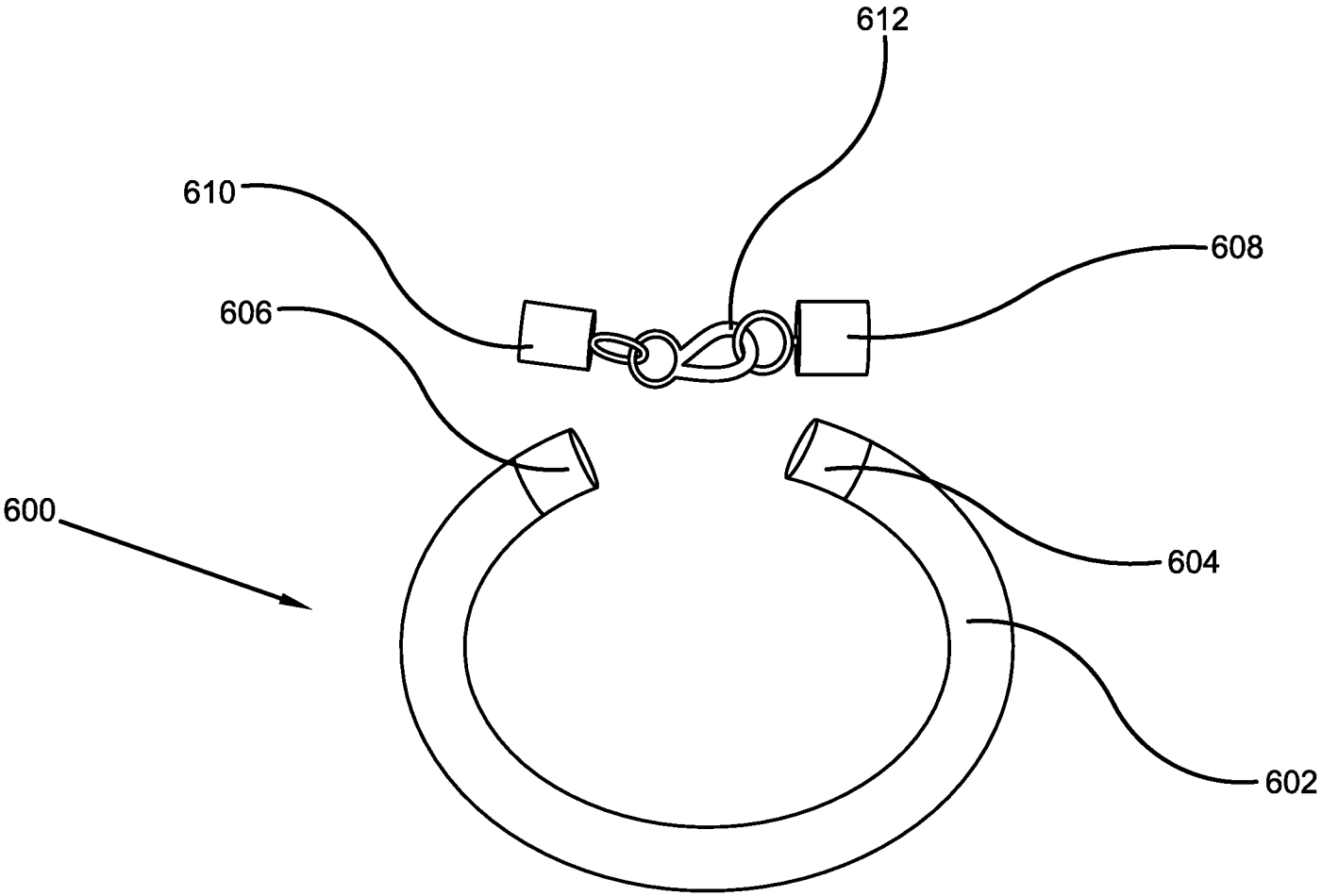
FIG. 6 illustrates a perspective view of yet another potential embodiment of the solar powered glowing article of the present invention in accordance with the disclosed architecture.

FIG. 6 illustrates a perspective view of yet another embodiment of glowing illumination article of the present invention in accordance with the disclosed specification. As illustrated, the article, here depicted as a bracelet 600, has a glowing arm cover 602 that has photocells and an illuminating source disposed therein. The glowing arm cover 602 has a magnetic battery housing 604, 606 wherein a first housing 604 stores a positive electrode of battery and a second housing 606 stores a negative electrode of battery.

A connecting chain 612, having connectors 608, 610, is used for making a closed loop allowing a user to wear the bracelet 600. The connectors 608, 610 are also configured to allow electric charge to flow from the battery to said illuminating source for illuminating the glowing arm cover 602.

Figure 7:
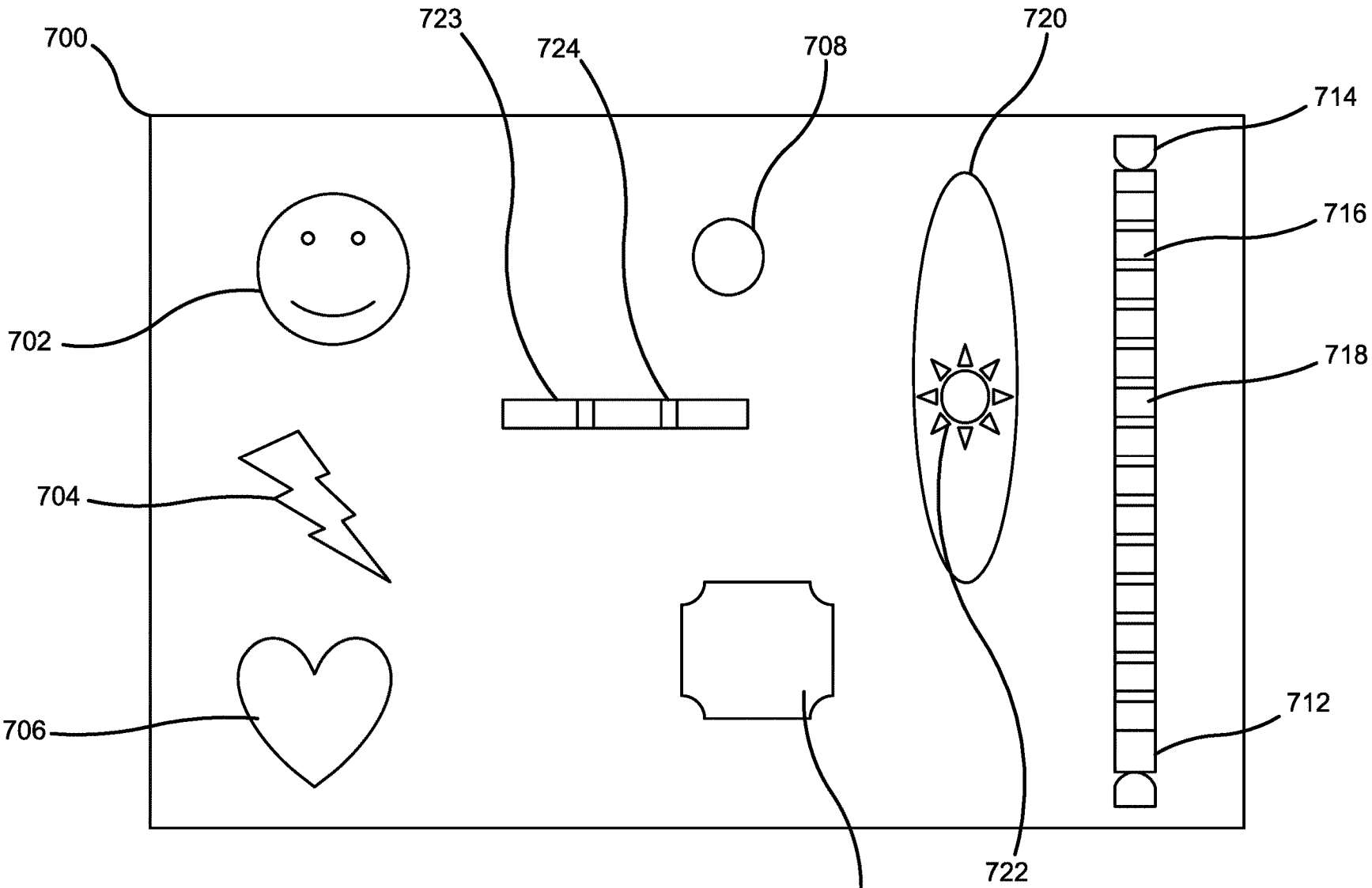
FIG. 7 illustrates a diagrammatic view of one potential embodiment of a kit that may be used for making a solar powered and glowing accessory in accordance with the disclosed architecture.

FIG. 7 provides a kit for making an illumination article. The kit includes a package 700 that contains a number of different elements allowing an individual to personalize their illumination item. The package is configured for one of retail or online sales. The kit includes several beads, charms, crystals, or other design/decorative elements 702, 704 and 706 which may be of the same color or different colors. A battery 708 is included with the kit as well as a photocell 710 to attach to the illumination article at a desired location. A hollow cord, rope, or string 712 having a clasp or closure 714, and the cord includes at least one LED 716 but in a preferred embodiment has multiple LED lights and they may be provided in different colors 718. The kit includes other types of an illumination article 720 which may also contain design elements 722. The kit further includes extension ropes 723 which may have different colored LEDs 724 allowing a user to create larger accessories such as a belt or strap, jump rope or the like.

Certain terms are used throughout the following description and claims to refer to particular features, or components. As one skilled in the art will appreciate, different persons may refer to the same feature or component by different names. This document does not intend to distinguish between components or features that differ in name but not structure or function. As used herein "glowing illumination article", "jewelry, adornment, accessory", "solar powered glowing article", and "glowing item" are interchangeable and refer to the solar powered reusable glowing article 100 of the present invention. Additionally, the terms "connected" or "attached" may also mean in electrical communication therewith.

Notwithstanding the foregoing, the solar powered reusable glowing illumination article 100 of the present invention can be of any suitable size and configuration as is known in the art without affecting the overall concept of the invention, provided that it accomplishes the above-stated objectives. One of ordinary skill in the art will appreciate that the solar powered reusable glowing article 100 as shown in the FIGS. are for illustrative purposes only, and that many other sizes and shapes of the solar powered reusable glowing article 100 are well within the scope of the present disclosure. Although the dimensions of the solar powered reusable glowing article 100 are important design parameters for user convenience, the solar powered reusable glowing item 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An illumination article comprising:

a transparent or translucent hollow cord having a first end and a second end;

an illumination source disposed within the hollow cord;

a solar collector in electrical communication with the illumination source;

a clasp for connecting the first and second ends, wherein the clasp comprises a sensor for activating the illumination source;

a battery, wherein the illumination source is an LED; and a charge meter in electrical communication with the battery.

2. The illumination article as recited in claim 1, wherein the illumination source does not require a chemical illumination.

3. The illumination article as recited in claim 1, wherein the illumination source is a plurality of LEDs.

4. The illumination article as recited in claim 3, wherein the plurality of LEDs are provided in a single color or a plurality of colors.

5. The illumination article as recited in claim 1 further comprising a timer and a controller in communication with the illumination source.

6. The illumination article as recited in claim 5, wherein the controller operates the illumination source in one of a continuous mode, a sequential mode, a blinking mode or a running mode.

7. The illumination article as recited in claim 1 further comprising an illumination control connected to the illumination source.

8. The illumination article as recited in claim 1, wherein the illumination article is one of a necklace, a bracelet, a wristband, a charm, a belt, a strap, a pendant, a broach, a ring, an earring, a helix piercing ring, a loop and a pin.

9. The illumination article as recited in claim 1, wherein the hollow cord has a diameter ranging between 1/32 and 2 inches.

10. The illumination article as recited in claim 1, wherein the hollow cord has a diameter ranging between 1/4 and 1 inch.

11. The illumination article as recited in claim 1, wherein the hollow cord comprises a cavity having a diameter ranging between 1/32 and 1/4 of an inch.

12. A fashion accessory comprising:

a hollow cord having a cavity;

a string of LED lights disposed within the cavity, wherein the string of LED lights are operable in at least one of a continuous mode, an intermittent mode, a blinking mode and a running mode;

a photocell connected to the hollow cord, wherein the photocell powers the string of LED lights;

a conductive circuit connected to each of the string of LED lights; and a battery connected to the photocell for storing an energy collected by the photocell and a charge meter to determine an energy level of the battery.

13. The fashion accessory as recited in claim 12 further comprising a timer and a controller for operating the sting of LED lights and illumination cycle.

14. The fashion accessory as recited in claim 12 further comprising an illumination controller for controlling a mode of operation of the string of LED lights.

15. The fashion accessory as recited in claim 12 further comprising a clasp sensor connected to a first end or a second end of the hollow tube and for completing the conductive circuit.

16. A kit for producing an illumination item, the comprising:

a package configured for one of a retail or an on-line sale;

at least one decorative element provided in the package for personalizing the illumination item;

a hollow cord having a cavity for containing at least one LED; and a photocell for collecting a solar energy and storing it in the battery.

17. The kit for producing an illumination item as recited in claim 16 further comprising a battery for powering the at least one LED and an extension tube having an LED light.

* * * * *